US008086456B2

(12) United States Patent
Beutnagel et al.

(10) Patent No.: US 8,086,456 B2
(45) **Date of Patent: *Dec. 27, 2011**

(54) METHODS AND APPARATUS FOR RAPID ACOUSTIC UNIT SELECTION FROM A LARGE SPEECH CORPUS

(75) Inventors: Mark Charles Beutnagel, Mendham, NJ (US); Mehryar Mohri, New York, NY (US); Michael Dennis Riley, New York, NY (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/839,937

(22) Filed: Jul. 20, 2010

(65) Prior Publication Data

US 2010/0286986 A1 Nov. 11, 2010

Related U.S. Application Data

(63) Continuation of application No. 12/057,020, filed on Mar. 27, 2008, now Pat. No. 7,761,299, which is a continuation of application No. 11/381,544, filed on May 4, 2006, now Pat. No. 7,369,994, which is a continuation of application No. 10/742,274, filed on Dec. 19, 2003, now Pat. No. 7,082,396, which is a continuation of application No. 10/359,171, filed on Feb. 6, 2003, now Pat. No. 6,701,295, which is a continuation of application No. 09/557,146, filed on Apr. 25, 2000, now Pat. No. 6,697,780.

(51) Int. Cl.
*G10L 13/04* (2006.01)
*G10L 13/06* (2006.01)

(52) U.S. Cl. ..... 704/258; 704/266

(58) Field of Classification Search ..... 704/258, 704/263, 266; 379/88.16

See application file for complete search history.

(56) References Cited

U.S. PATENT DOCUMENTS

| | | | | |
|---|---|---|---|---|
| 5,740,320 | A * | 4/1998 | Itoh | 704/267 |
| 5,751,907 | A * | 5/1998 | Moebius et al. | 704/267 |
| 5,870,706 | A | 2/1999 | Alshawi | |
| 5,878,393 | A * | 3/1999 | Hata et al. | 704/260 |
| 5,913,193 | A | 6/1999 | Huang et al. | |
| 5,970,460 | A | 10/1999 | Bunce et al. | |

(Continued)

OTHER PUBLICATIONS

Chu et al., "Selecting Non-Uniform Units from a Very Large Corpus for Concatenative Speech Synthesizer," 2001 IEEE International Conference on Acoustics, Speech and Signal Processing, vol. 2, May 2001, pp. 785-788.

(Continued)

*Primary Examiner* — Martin Lerner

(57) ABSTRACT

A speech synthesis system can select recorded speech fragments, or acoustic units, from a very large database of acoustic units to produce artificial speech. The selected acoustic units are chosen to minimize a combination of target and concatenation costs for a given sentence. However, as concatenation costs, which are measures of the mismatch between sequential pairs of acoustic units, are expensive to compute, processing can be greatly reduced by pre-computing and caching the concatenation costs. Unfortunately, the number of possible sequential pairs of acoustic units makes such caching prohibitive. A method for constructing an efficient concatenation cost database is provided by synthesizing a large body of speech, identifying the acoustic unit sequential pairs generated and their respective concatenation costs. By constructing a concatenation cost database in this fashion, the processing power required at run-time is greatly reduced with negligible effect on speech quality.

17 Claims, 5 Drawing Sheets

U.S. PATENT DOCUMENTS

| | | | | |
|---|---|---|---|---|
| 6,006,181 | A | 12/1999 | Buhrke et al. | |
| 6,101,470 | A * | 8/2000 | Eide et al. | 704/260 |
| 6,119,086 | A * | 9/2000 | Ittycheriah et al. | 704/267 |
| 6,125,346 | A * | 9/2000 | Nishimura et al. | 704/258 |
| 6,144,939 | A * | 11/2000 | Pearson et al. | 704/258 |
| 6,173,263 | B1 | 1/2001 | Conkie | |
| 6,202,049 | B1 * | 3/2001 | Kibre et al. | 704/267 |
| 6,233,544 | B1 | 5/2001 | Alshawi | |
| 6,266,637 | B1 | 7/2001 | Donovan et al. | |
| 6,266,638 | B1 * | 7/2001 | Stylianou | 704/266 |
| 6,366,883 | B1 | 4/2002 | Campbell et al. | |
| 6,370,522 | B1 | 4/2002 | Agarwal et al. | |
| 6,385,580 | B1 * | 5/2002 | Lyberg et al. | 704/258 |
| 6,505,158 | B1 | 1/2003 | Conkie | |
| 6,665,641 | B1 * | 12/2003 | Coorman et al. | 704/260 |
| 6,684,187 | B1 | 1/2004 | Conkie | |
| 6,697,780 | B1 | 2/2004 | Beutnagel et al. | |
| 6,701,295 | B2 | 3/2004 | Beutnagel et al. | |
| 6,950,798 | B1 | 9/2005 | Beutnagel et al. | |
| 6,961,704 | B1 | 11/2005 | Phillips | |
| 6,988,069 | B2 | 1/2006 | Phillips | |
| 7,013,278 | B1 | 3/2006 | Conkie | |
| 7,027,568 | B1 * | 4/2006 | Simpson et al. | 379/88.16 |
| 7,047,194 | B1 * | 5/2006 | Buskies | 704/258 |
| 7,082,396 | B1 | 7/2006 | Beutnagel et al. | |
| 7,124,083 | B2 | 10/2006 | Conkie | |
| 7,127,396 | B2 | 10/2006 | Chu et al. | |
| 7,233,901 | B2 | 6/2007 | Conkie | |
| 7,266,497 | B2 | 9/2007 | Conkie et al. | |
| 7,369,994 | B1 | 5/2008 | Beutnagel et al. | |
| 7,460,997 | B1 | 12/2008 | Conkie | |
| 7,565,291 | B2 | 7/2009 | Conkie | |
| 7,567,896 | B2 | 7/2009 | Coorman et al. | |
| 7,587,320 | B2 | 9/2009 | Conkie et al. | |
| 7,630,896 | B2 | 12/2009 | Tamura et al. | |
| 7,761,299 | B1 * | 7/2010 | Beutnagel et al. | 704/258 |
| 2003/0115049 | A1 | 6/2003 | Beutnagel et al. | |
| 2004/0093213 | A1 | 5/2004 | Conkie | |
| 2004/0153324 | A1 | 8/2004 | Phillips | |
| 2005/0137870 | A1 | 6/2005 | Mizutani et al. | |
| 2005/0182629 | A1 | 8/2005 | Coorman et al. | |
| 2008/0077407 | A1 | 3/2008 | Beutnagel et al. | |

OTHER PUBLICATIONS

Lee et al., "A Very Low Bit Rate Speech Coder Based on a Recognition/Synthesis Paradigm," IEEE Transactions on Speech and Audio Processing, vol. 9, No. 5, Jul. 2001, pp. 482-491.

Veldhuis et al., "On the Computation of the Kullback-Leibler Measure of Spectral Distances," IEEE Transactions on Speech and Audio Processing, vol. 11, No. 1, Jan. 2003, pp. 100-103.

Robert Endre Trajan and Andrew Chi-Chih Yao, "Storing a Sparse Table", Communication of the ACM, vol. 22:11, pp. 606-611, Nov. 1979.

Y. Stylianou (1998) "Concatenative Speech Synthesis using a Harmonic plus Noise Model", Workshop on Speech Synthesis, Jenolan Caves, NSW, Australia, Nov. 1998.

Hunt et al., "Unit Selection in a Concatenative Speech Synthesis using a Large Speech Database," 1996 IEEE International Conference on Acoustics, Speech and Signal Processing, vol. 1, May 1996, pp. 373-376.

Beutnagel et al., "Rapid Unit Selection from a Large Speech Corpus for Concatenative Speech Synthesis", AT&T Labs Research, Florham Park, New Jersey, 1999.

Webopedia, definition of "hashing", http://www.webopedia.com/TERM/H/hashing.html. 1 page, Jan. 23, 2003.

TechTarget, definition of "hashing", http://searchdatabase.techtarget.com/sDefinition/O,,sid13_gci212230,00.html, 2 pages. Jan. 23, 2003.

* cited by examiner

METHODS AND APPARATUS FOR RAPID ACOUSTIC UNIT SELECTION FROM A LARGE SPEECH CORPUS

RELATED APPLICATIONS

This non-provisional application is a continuation of U.S. application Ser. No. 12/057,020, filed Jul. 20, 2010, now U.S. Pat. No. 7,761,299, which is a continuation of U.S. patent application Ser. No. 11/381,544, filed on May 4, 2006, now U.S. Pat. No. 7,369,994, which is a continuation of U.S. patent application Ser. No. 10/742,274, filed on Dec. 19, 2003, now U.S. Pat. No. 7,082,396, which is a continuation of U.S. patent application Ser. No. 10/359,171, filed on Feb. 6, 2003, now U.S. Pat. No. 6,701,295, which is a continuation of U.S. patent application Ser. No. 09/557,146, filed on Apr. 25, 2000, now U.S. Pat. No. 6,697,780, which claims the benefit of U.S. Provisional Application No. 60/131,948, filed on Apr. 30, 1999. Each of these patent applications is incorporated herein by reference in its entirety.

BACKGROUND OF THE INVENTION

1. The Field of the Invention

The invention relates to methods and apparatus for synthesizing speech.

2. Description of Related Art

Rule-based speech synthesis is used for various types of speech synthesis applications including Text-To-Speech (TTS) and voice response systems. Typical rule-based speech synthesis techniques involve concatenating pre-recorded phonemes to form new words and sentences.

Previous concatenative speech synthesis systems create synthesized speech by using single stored samples for each phoneme in order to synthesize a phonetic sequence. A phoneme, or phone, is a small unit of speech sound that serves to distinguish one utterance from another. For example, in the English language, the phoneme /r/ corresponds to the letter "R" while the phoneme /t/ corresponds to the letter "T". Synthesized speech created by this technique sounds unnatural and is usually characterized as "robotic" or "mechanical."

More recently, speech synthesis systems started using large inventories of acoustic units with many acoustic units representing variations of each phoneme. An acoustic unit is a particular instance, or realization, of a phoneme. Large numbers of acoustic units can all correspond to a single phoneme, each acoustic unit differing from one another in terms of pitch, duration, and stress as well as various other qualities. While such systems produce a more natural sounding voice quality, to do so they require a great deal of computational resources during operation. Accordingly, there is a need for new methods and apparatus to provide natural voice quality in synthetic speech while reducing the computational requirements.

BRIEF SUMMARY OF THE INVENTION

The invention provides methods and apparatus for speech synthesis by selecting recorded speech fragments, or acoustic units, from an acoustic unit database. To aide acoustic unit selection, a measure of the mismatch between pairs of acoustic units, or concatenation cost, is pre-computed and stored in a database. By using a concatenation cost database, great reductions in computational load are obtained compared to computing concatenation costs at run-time.

The concatenation cost database can contain the concatenation costs for a subset of all possible acoustic unit sequential pairs. Given that only a fraction of all possible concatenation costs are provided in the database, the situation can arise where the concatenation cost for a particular sequential pair of acoustic units is not found in the concatenation cost database. In such instances, either a default value is assigned to the sequential pair of acoustic units or the actual concatenation cost is derived.

The concatenation cost database can be derived using statistical techniques which predict the acoustic unit sequential pairs most likely to occur in common speech. The invention provides a method for constructing a medium with an efficient concatenation cost database by synthesizing a large body of speech, identifying the acoustic unit sequential pairs generated and their respective concatenation costs, and storing the concatenation costs values on the medium.

Other features and advantages of the present invention will be described below or will become apparent from the accompanying drawings and from the detailed description which follows.

BRIEF DESCRIPTION OF THE DRAWINGS

The invention is described in detail with regard to the following figures, wherein like numerals reference like elements, and wherein.

DETAILED DESCRIPTION OF THE PREFERRED EMBODIMENTS

Figure 1:
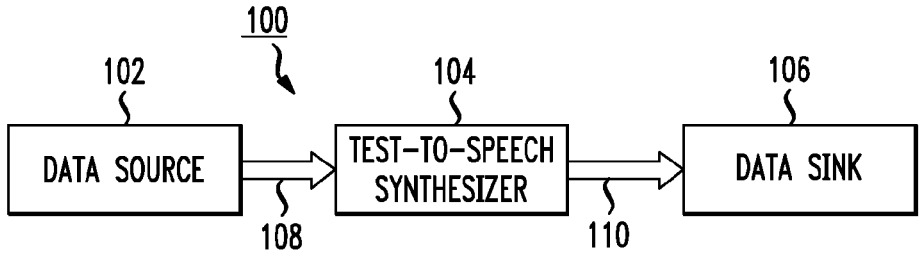
FIG. 1 is an exemplary block diagram of a text-to-speech synthesizer system according to the present invention.

FIG. 1 shows an exemplary block diagram of a speech synthesizer system 100. The system 100 includes a text-to-speech synthesizer 104 that is connected to a data source 102 through an input link 108 and to a data sink 106 through an output link 110. The text-to-speech synthesizer 104 can receive text data from the data source 102 and convert the text data either to speech data or physical speech. The text-to-speech synthesizer 104 can convert the text data by first converting the text into a stream of phonemes representing the speech equivalent of the text, then process the phoneme stream to produce an acoustic unit stream representing a clearer and more understandable speech representation, and then convert the acoustic unit stream to speech data or physical speech.

The data source 102 can provide the text-to-speech synthesizer 104 with data which represents the text to be synthesized into speech via the input link 108. The data representing the text of the speech to be synthesized can be in any format, such as binary, ASCII or a word processing file. The data source 102 can be any one of a number of different types of data sources, such as a computer, a storage device, or any combination of software and hardware capable of generating, relaying, or recalling from storage a textual message or any information capable of being translated into speech.

The data sink 106 receives the synthesized speech from the text-to-speech synthesizer 104 via the output link 110. The data sink 106 can be any device capable of audibly outputting speech, such as a speaker system capable of transmitting mechanical sound waves, or it can be a digital computer, or any combination of hardware and software capable of receiving, relaying, storing, sensing or perceiving speech sound or information representing speech sounds.

The links 108 and 110 can be any known or later developed device or system for connecting the data source 102 or the data sink 106 to the text-to-speech synthesizer 104. Such devices include a direct serial/parallel cable connection, a connection over a wide area network or a local area network, a connection over an intranet, a connection over the Internet, or a connection over any other distributed processing network or system. Additionally, the input link 108 or the output link 110 can be software devices linking various software systems. In general, the links 108 and 110 can be any known or later developed connection system, computer program, or structure useable to connect the data source 102 or the data sink 106 to the text-to-speech synthesizer 104.

Figure 2:
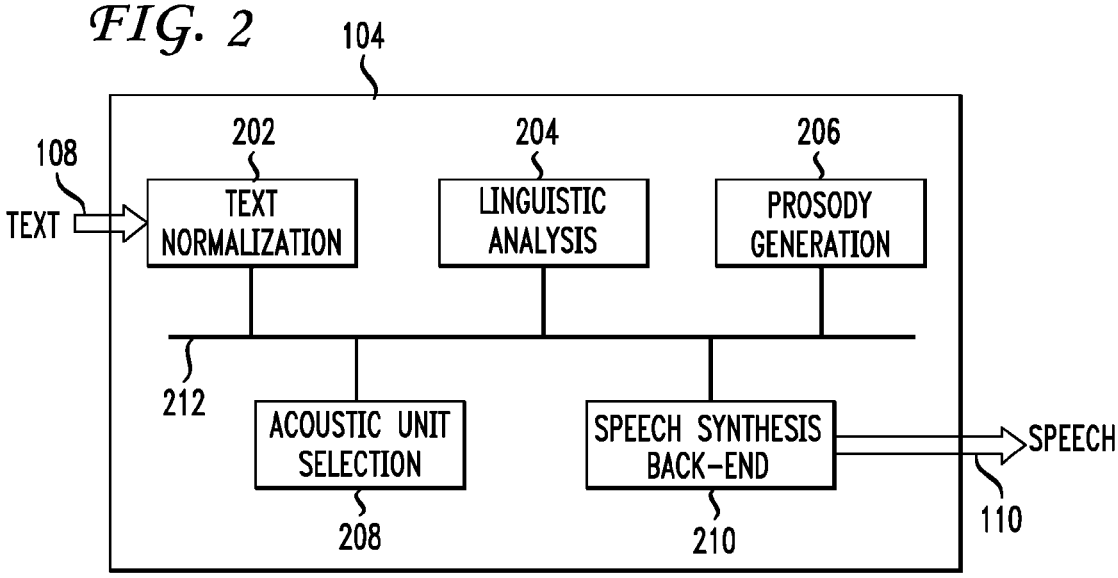
FIG. 2 is an exemplary block diagram of the text-to-speech synthesizer of FIG. 1.

FIG. 2 is an exemplary block diagram of the text-to-speech synthesizer 104. The text-to-speech synthesizer 104 receives textual data on the input link 108 and converts the data into synthesized speech data which is exported on the output link 110. The text-to-speech synthesizer 104 includes a text normalization device 202, linguistic analysis device 204, prosody generation device 206, an acoustic unit selection device 208 and a speech synthesis back-end device 210. The above components are coupled together by a control/data bus 212.

In operation, textual data can be received from an external data source 102 using the input link 108. The text normalization device 202 can receive the text data in any readable format, such as an ASCII format. The text normalization device can then parse the text data into known words and further convert abbreviations and numbers into words to produce a corresponding set of normalized textual data. Text normalization can be done by using an electronic dictionary, database or informational system now known or later developed without departing from the spirit and scope of the present invention.

The text normalization device 202 then transmits the corresponding normalized textual data to the linguistic analysis device 204 via the data bus 212. The linguistic analysis device 204 can translate the normalized textual data into a format consistent with a common stream of conscious human thought. For example, the text string "$10", instead of being translated as "dollar ten", would be translated by the linguistic analysis unit 11 as "ten dollars." Linguistic analysis devices and methods are well known to those skilled in the art and any combination of hardware, software, firmware, heuristic techniques, databases, or any other apparatus or method that performs linguistic analysis now known or later developed can be used without departing from the spirit and scope of the present invention.

The output of the linguistic analysis device 204 can be a stream of phonemes. A phoneme, or phone, is a small unit of speech sound that serves to distinguish one utterance from another. The term phone can also refer to different classes of utterances such as poly-phonemes and segments of phonemes such as half-phones. For example, in the English language, the phoneme /r/ corresponds to the letter "R" while the phoneme /t/ corresponds to the letter "T". Furthermore, the phoneme /r/ can be divided into two half-phones /$r_l$/ and /$r_r$/ which together could represent the letter "R". However, simply knowing what the phoneme corresponds to is often not enough for speech synthesizing because each phoneme can represent numerous sounds depending upon its context.

Accordingly, the stream of phonemes can be further processed by the prosody generation device 206 which can receive and process the phoneme data stream to attach a number of characteristic parameters describing the prosody of the desired speech. Prosody refers to the metrical structure of verse. Humans naturally employ prosodic qualities in their speech such as vocal rhythm, inflection, duration, accent and patterns of stress. A "robotic" voice, on the other hand, is an example of a non-prosodic voice. Therefore, to make synthesized speech sound more natural, as well as understandable, prosody must be incorporated.

Prosody can be generated in various ways including assigning an artificial accent or providing for sentence context. For example, the phrase "This is a test!" will be spoken differently from "This is a test?" Prosody generating devices and methods are well known to those of ordinary skill in the art and any combination of hardware, software, firmware, heuristic techniques, databases, or any other apparatus or method that performs prosody generation now known or later developed can be used without departing from the spirit and scope of the invention.

The phoneme data along with the corresponding characteristic parameters can then be sent to the acoustic unit selection device 208 where the phonemes and characteristic parameters can be transformed into a stream of acoustic units that represent speech. An acoustic unit is a particular utterance of a phoneme. Large numbers of acoustic units can all correspond to a single phoneme, each acoustic unit differing from one another in terms of pitch, duration, and stress as well as various other phonetic or prosodic qualities. Subsequently, the acoustic unit stream can be sent to the speech synthesis back end device 210 which converts the acoustic unit stream into speech data and can transmit the speech data to a data sink 106 over the output link 110.

Figure 3:
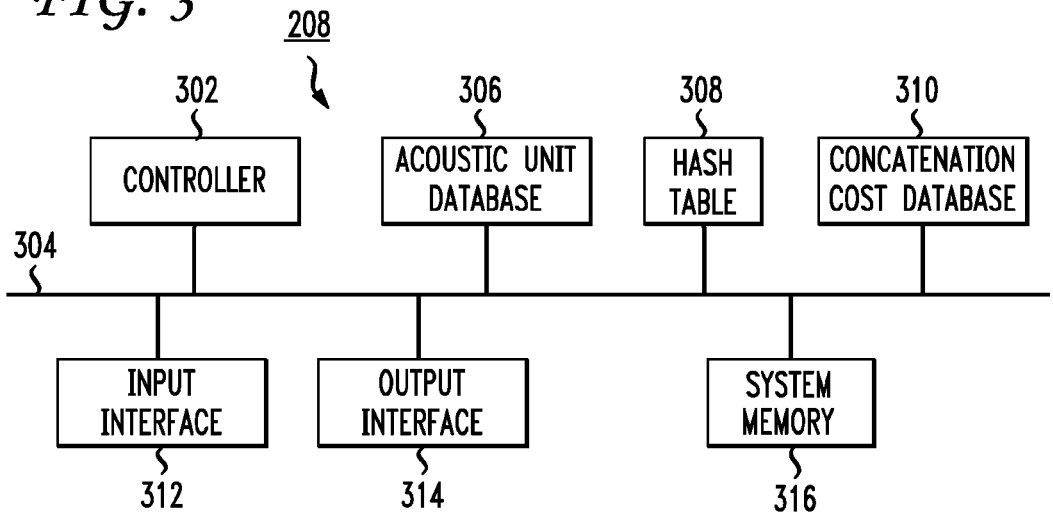
FIG. 3 is an exemplary block diagram of the acoustic unit selection device, as shown in FIG. 2.

FIG. 3 shows an exemplary embodiment of the acoustic unit selection device 208 which can include a controller 302, an acoustic unit database 306, a hash table 308, a concatenation cost database 310, an input interface 312, an output interface 314, and a system memory 316. The above components are coupled together through control/data bus 304.

In operation, and under the control of the controller 302, the input interface 312 can receive the phoneme data along with the corresponding characteristic parameters for each phoneme which represent the original text data. The input interface 312 can receive input data from any device, such as a keyboard, scanner, disc drive, a UART, LAN, WAN, parallel digital interface, software interface or any combination of software and hardware in any form now known or later developed. Once the controller 302 imports a phoneme stream with its characteristic parameters, the controller 302 can store the data in the system memory 316.

The controller 302 then assigns groups of acoustic units to each phoneme using the acoustic unit database 306. The acoustic unit database 306 contains recorded sound fragments, or acoustic units, which correspond to the different phonemes. In order to produce a very high quality of speech, the acoustic unit database 306 can be of substantial size wherein each phoneme can be represented by hundreds or even thousands of individual acoustic units. The acoustic units can be stored in the form of digitized speech. However, it is possible to store the acoustic units in the database in the form of Linear Predictive Coding (LPC) parameters, Fourier representations, wavelets, compressed data or in any form now known or later discovered.

Next, the controller 302 accesses the concatenation cost database 310 using the hash table 308 and assigns concatenation costs between every sequential pair of acoustic units. The concatenation cost database 310 of the exemplary embodiment contains the concatenation costs of a subset of the possible acoustic unit sequential pairs. Concatenation costs are measures of mismatch between two acoustic units that are sequentially ordered. By incorporating and referencing a database of concatenation costs, run-time computation is substantially lower compared to computing concatenation costs during run-time. Unfortunately, a complete concatenation cost database can be inconveniently large. However, a well-chosen subset of concatenation costs can constitute the database 310 with little effect on speech quality.

After the concatenation costs are computed or assigned, the controller 302 can select the sequence of acoustic units that best represents the phoneme stream based on the concatenation costs and any other cost function relevant to speech synthesis. The controller then exports the selected sequence of acoustic units via the output interface 314.

While it is preferred that the acoustic unit database 306, the concatenation cost database 310, the hash table 308 and the system memory 314 in FIG. 1 reside on a high-speed memory such as a static random access memory, these devices can reside on any computer readable storage medium including a CD-ROM, floppy disk, hard disk, read only memory (ROM), dynamic RAM, and FLASH memory.

The output interface 314 is used to output acoustic information either in sound form or any information form that can represent sound. Like the input interface 312, the output interface 314 should not be construed to refer exclusively to hardware, but can be any known or later discovered combination of hardware and software routines capable of communicating or storing data.

Figure 4:
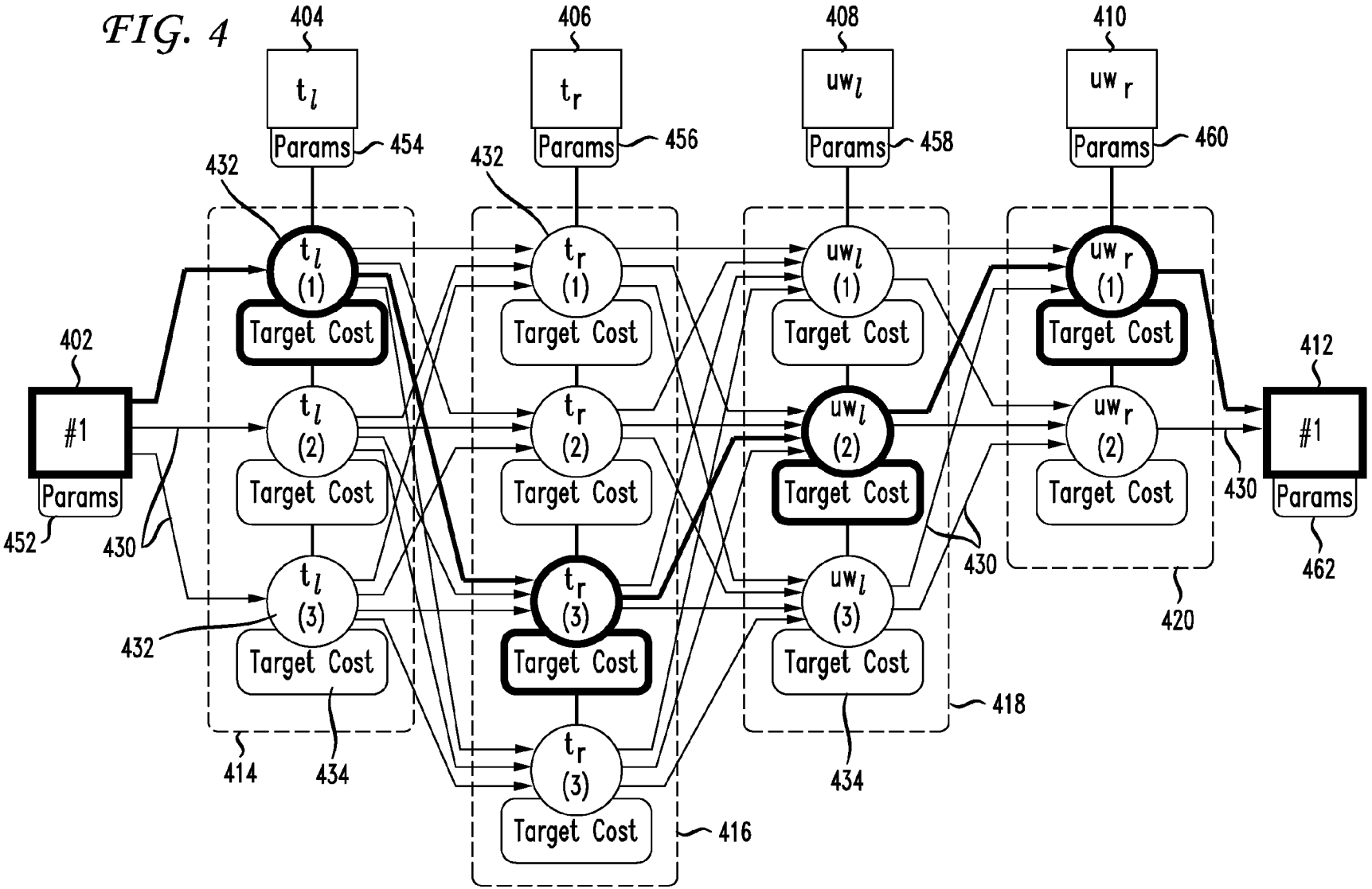
FIG. 4 is an exemplary block diagram illustrating acoustic unit selection.

FIG. 4 shows an example of a phoneme stream 402-412 with a set of characteristic parameters 452-462 assigned to each phoneme accompanied by acoustic units groups 414-420 corresponding to each phoneme 402-412. In this example, the sequence /silence/ 402-/t/-/uw/-/silence/ 412 representing the word "two" is shown as well as the relationships between the various acoustic units and phonemes 402-412. Each phoneme /t/ and /uw/ is divided into instances of left-half phonemes (subscript "l") and right-half phonemes (subscript "r") /$t_l$/ 404, /$t_r$/ 406, /$uw_l$/ 408 and /$uw_r$/ 410, respectively. As shown in FIG. 4, the phoneme /$t_l$/ 404 is assigned a first acoustic unit group 414, /$t_r$/ 406 is assigned a second acoustic unit group 416, /$uw_l$/ 408 is assigned a third acoustic unit group 418 and /$uw_r$/ 410 is assigned a fourth acoustic unit group 420. Each acoustic unit group 414-420 includes at least one acoustic unit 432 and each acoustic unit 432 includes an associated target cost 434. Target costs 434 are estimates of the mismatch between each phoneme 402-412 with its accompanying parameters 452-462 and each recorded acoustic unit 432 in the group corresponding to each phoneme. Concatenation costs 430, represented by arrows, are assigned between each acoustic unit 432 in a given group and the acoustic units 432 of an immediate subsequent group. As discussed above, concatenation costs 430 are estimates of the acoustic mismatch between two acoustic units 432. Such acoustic mismatch can manifest itself as "clicks", "pops", noise and other unnaturalness within a stream of speech.

The example of FIG. 4 is scaled down for clarity. The exemplary speech synthesizer 104 incorporates approximately eighty-four thousand (84,000) distinct acoustic units 432 corresponding to ninety-six (96) half-phonemes. A more accurate representation can show groups of hundreds or even thousands of acoustic units for each phone, and the number of distinct phonemes and acoustic units can vary significantly without departing from the spirit and scope of the present invention.

Once the data structure of phonemes and acoustic units is established, acoustic unit selection begins by searching the data structure for the least cost path between all acoustic units 432 taking into account the various cost functions, i.e., the target costs 432 and the concatenation costs 430. The controller 302 selects acoustic units 432 using a Viterbi search technique formulated with two cost functions: (1) the target cost 434 mentioned above, defined between each acoustic unit 432 and respective phone 404-410, and (2) concatenation costs (join costs) 430 defined between each acoustic unit sequential pair.

FIG. 4 depicts the various target costs 434 associated with each acoustic unit 432 and the concatenation costs 430 defined between sequential pairs of acoustic units. For example, the acoustic unit represented by $t_r$(1) in the second acoustic unit group 416 has an associated target costs 434 that represents the mismatch between acoustic unit $t_r$(1) and the phoneme /$t_r$/ 406.

Additionally, the phoneme $t_r$(1) in the second acoustic unit group 416 can be sequentially joined by any one of the phonemes $uw_l$(1), $uw_l$(2) and $uw_l$(3) in the third acoustic unit group 418 to form three separate sequential acoustic unit pairs, $t_r$(1)-$uw_l$(1), $t_r$(1)-$uw_l$(2) and $t_r$(1)-$uw_l$(3). Connecting each sequential pair of acoustic units is a separate concatenation cost 430, each represented by an arrow.

The concatenation costs 430 are estimates of the acoustic mismatch between two acoustic units. The purpose of using concatenation costs 430 is to smoothly join acoustic units using as little processing as possible. The greater the acoustic mismatch between two acoustic units, the more signal processing must be done to eliminate the discontinuities. Such discontinuities create noticeable "pops" and "clicks" in the synthesized speech that impairs the intelligibility and quality of the resulting synthesized speech. While signal processing can eliminate much or all of the discontinuity between two acoustic units, the run-time processing decreases and synthesized speech quality improves with reduced discontinuities.

A target costs 434, as mentioned above, is an estimate of the mismatch between a recorded acoustic unit and the specification of each phoneme. The target costs 434 function is to aide in choosing appropriate acoustic units, i.e., a good fit to the specification that will require little or no signal processing. Target costs $C^t$ for a phone specification $t_i$ and acoustic unit $u_i$ is the weighted sum of target subcosts $C^t_j$; across the phones j from 1 to p. Target costs $C^t$ can be represented by the equation:

$$C^t(t_{i,}, u_i) = \sum_{j=1}^{p} \omega^t_j C^t_j(t_{i,}, u_i)$$

where p is the total number of phones in the phoneme stream.

For example, the target costs 434 for the acoustic unit $t_r$(1) and the phoneme /$t_r$/ 406 with its associated characteristics can be fifteen (15) while the target cost 434 for the acoustic unit $t_r$(2) can be ten (10). In this example, the acoustic unit $t_r$(2) will require less processing than $t_r$(1) and therefore $t_r$(2) represents a better fit to phoneme /$t_r$/.

The concatenation cost $C^c$ for acoustic units $u_{i-1}$ and $u_i$ is the weighted sum of subcosts $C^c_j$ across phones j from 1 to p. Concatenation costs can be represented by the equation:

$$C^c(u_{i-1}, u_i) = \sum_{j=1}^{p} \omega_j^c C_j^c(u_{i-1}, u_i)$$

where p is the total number of phones in the phoneme stream

For example, assume that the concatenation cost 430 between the acoustic unit $t_r$(3) and $uw_l$(1) is twenty (20) while the concatenation cost 430 between $t_r$(3) and $uw_l$(2) is ten (10) and the concatenation cost 430 between acoustic unit $t_r$(3) and $uw_l$(3) is zero. In this example, the transition $t_r$(3)-$uw_l$(2) provides a better fit than $t_r$(3)-$uw_l$(1), thus requiring less processing to smoothly join them. However, the transition $t_r$(3)-$uw_l$(3) provides the smoothest transition of the three candidates and the zero concatenation cost 430 indicates that no processing is required to join the acoustic unit sequential pairs $t_r$(3)-$uw_l$(3).

The task of acoustic unit selection then is finding acoustic units $u_i$ from the recorded inventory of acoustic units 306 that minimize the sum of these two costs 430 and 434, accumulated across all phones i in an utterance. The task can be represented by the following equation:

$$C^t(t_i, u_i) = \sum_{j=1}^{p} C^t(t_{i,}, u_i) + \sum_{j=2}^{p} \omega_j^c C_j^c(u_{i-1}, u_i)$$

where p is the total number of phones in a phoneme stream.

A Viterbi search can be used to minimize $C^t(t_i,u_i)$ by determining the least cost path that minimizes the sum of the target costs 434 and concatenation costs 430 for a phoneme stream with a given set of phonetic and prosodic characteristics. FIG. 4 depicts an exemplary least cost path, shown in bold, as the selected acoustic units 432 which solves the least cost sum of the various target costs 434 and concatenation costs 430. While the exemplary embodiment uses two costs functions, target cost 434 and concatenation cost 430, other cost functions can be integrated without departing from the spirit and scope of the present invention.

Figure 5:
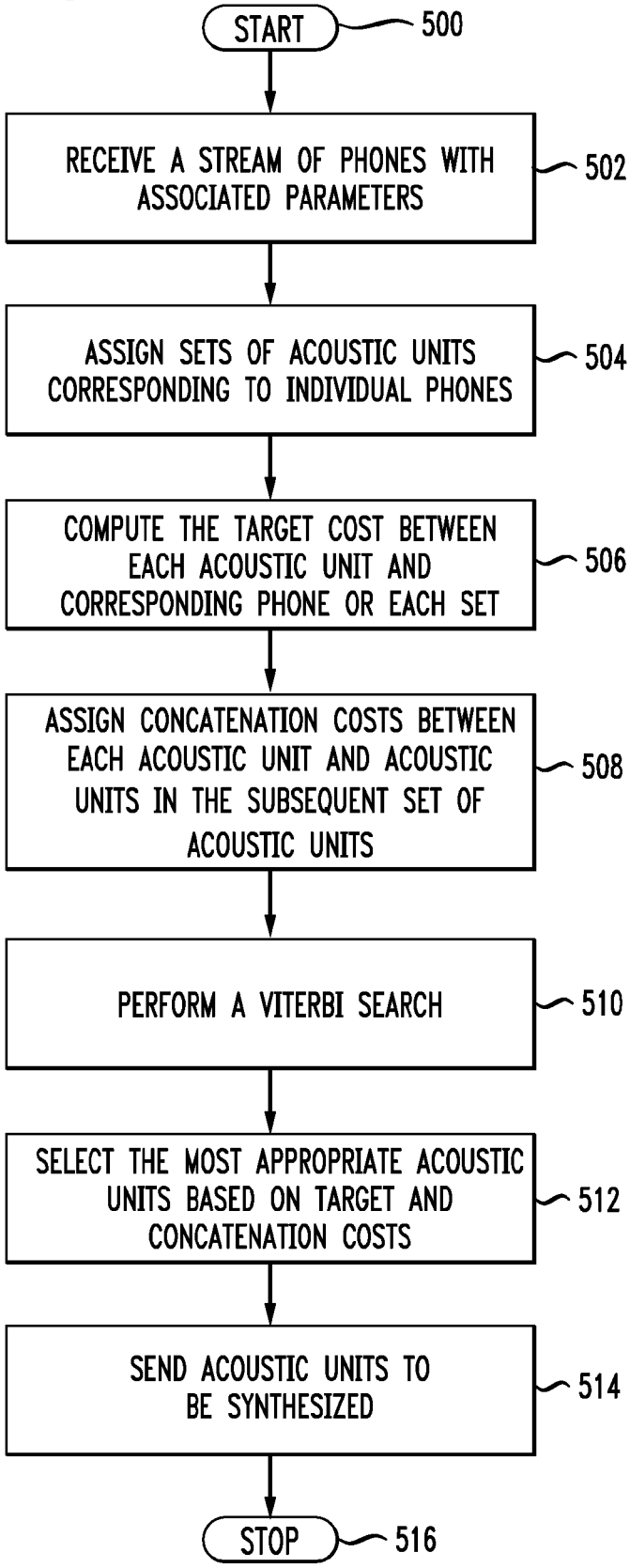
FIG. 5 is a flowchart illustrating an exemplary method for selecting acoustic units in accordance with the present invention

FIG. 5 is a flowchart outlining one exemplary method for selecting acoustic units. The operation starts with step 500 and control continues to step 502. In step 502 a phoneme stream having a corresponding set of associated characteristic parameters is received. For example, as shown in FIG. 4, the sequence /silence/ 402-/$t_l$/ 404-/$t_r$/ 406-$uw_l$/ 408-/$uw_r$/ 410-/silence/ 412 depicts a phoneme stream representing the word "two".

Next, in step 504, groups of acoustic units are assigned to each phoneme in the phoneme stream. Again, referring to FIG. 4, the phoneme /$t_l$/ 404 is assigned a first acoustic unit group 414. Similarly, the phonemes other than /silence/ 402 and 412 are assigned groups of acoustic units.

The process then proceeds to step 506, where the target costs 434 are computed between each acoustic unit 432 and a corresponding phoneme with assigned characteristic parameters. Next, in step 508, concatenation costs 430 between each acoustic unit 432 and every acoustic unit 432 in a subsequent set of acoustic units are assigned.

In step 510, a Viterbi search determines the least cost path of target costs 434 and concatenation costs 430 across all the acoustic units in the data stream. While a Viterbi search is the preferred technique to select the most appropriate acoustic units 432, any technique now known or later developed suited to optimize or approximate an optimal solution to choose acoustic units 432 using any combination of target costs 434, concatenation costs 430, or any other cost function can be used without deviating from the spirit and scope of the present invention.

Next, in step 512, acoustic units are selected according to the criteria of step 510. FIG. 4 shows an exemplary least cost path generated by a Viterbi search technique (shown in bold) as /silence/ 402-$t_l$(1)-$t_r$(3)-$uw_L$(2)-$uw_r$(1)-/silence/ 412. This stream of acoustic units will output the most understandable and natural sounding speech with the least amount of processing. Finally, in step 514, the selected acoustic units 432 are exported to be synthesized and the operation ends with step 516.

The speech synthesis technique of the present example is the Harmonic Plus Noise Model (HNM). The details of the HNM speech synthesis back-end are more fully described in Beutnagel, Mohri, and Riley, "Rapid Unit Selection from a large Speech Corpus for Concatenative Speech Synthesis" and Y. Stylianou (1998) "Concatenative speech synthesis using a Harmonic plus Noise Model", Workshop on Speech Synthesis, Jenolan Caves, NSW, Australia, November 1998, incorporated herein by reference.

While the exemplary embodiment uses the HNM approach to synthesize speech, the HNM approach is but one of many viable speech synthesis techniques that can be used without departing from the spirit and scope of the present invention. Other possible speech synthesis techniques include, but are not limited to, simple concatenation of unmodified speech units, Pitch-Synchronous OverLap and Add (PSOLA), Waveform-Synchronous OverLap and Add (WSOLA), Linear Predictive Coding (LPC), Multipulse LPC, Pitch-Synchronous Residual Excited Linear Prediction (PSRELP) and the like.

As discussed above, to reduce run-time computation, the exemplary embodiment employs the concatenation cost database 310 so that computing concatenation costs at run-time can be avoided. Also as noted above, a drawback to using a concatenation cost database 310 as opposed to computing concatenation costs is the large memory requirements that arise. In the exemplary embodiment, the acoustic library consists of a corpus of eighty-four thousand (84,000) half-units (42,000 left-half and 42,000 right-half units) and, thus, the size of a concatenation cost database 310 becomes prohibitive considering the number of possible transitions. In fact, this exemplary embodiment yields 1.76 billion possible combinations. Given the large number of possible combinations, storing of the entire set of concatenation costs becomes prohibitive. Accordingly, the concatenation cost database 310 must be reduced to a manageable size.

One technique to reduce the concatenation cost database 310 size is to first eliminate some of the available acoustic units 432 or "prune" the acoustic unit database 306. One possible method of pruning would be to synthesize a large body of text and eliminate those acoustic units 432 that rarely occurred. However, experiments reveal that synthesizing a large test body of text resulted in about 85% usage of the eighty-four thousand (84,000) acoustic units in a half-phone based synthesizer. Therefore, while still a viable alternative, pruning any significant percentage of acoustic units 432 can result in a degradation of the quality of speech synthesis.

A second method to reduce the size of the concatenation cost database 310 is to eliminate from the database 310 those acoustic unit sequential pairs that are unlikely to occur naturally. As shown earlier, the present embodiment can yield 1.76 billion possible combinations. However, since experiments show the great majority of sequences seldom, if ever, occur naturally, the concatenation cost database 310 can be substantially reduced without speech degradation. The concatenation cost database 310 of the example can contains concatenation costs 430 for a subset of less than 1% of the possible acoustic unit sequential pairs.

Given that the concatenation cost database 310 only includes a fraction of the total concatenation costs 430, the situation can arise where the concatenation cost 430 for an incident acoustic sequential pair does not reside in the database 310. These occurrences represent acoustic unit sequential pairs that occur but rarely in natural speech, or the speech is better represented by other acoustic unit combinations or that are arbitrarily requested by a user who enters it manually. Regardless, the system should be able to process any phonetic input.

FIG. 5 shows the process wherein concatenation costs 430 are assigned for arbitrary acoustic unit sequential pairs in the exemplary embodiment. The operation starts in step 600 and proceeds to step 602 where an acoustic unit sequential pair in a given stream is identified. Next, in step 604, the concatenation cost database 310 is referenced to see if the concatenation cost 430 for the immediate acoustic unit sequential pair exists in the concatenation cost database 310.

In step 606, a determination is made as to whether the concatenation cost 430 for the immediate acoustic unit sequential pair appears in the database 310. If the concatenation cost 430 for the immediate sequential pair appears in the concatenation cost database 310, step 610 is performed; otherwise step 608 is performed.

In step 610, because the concatenation cost 430 for the immediate sequential pair is in the concatenation cost database 310, the concatenation cost 430 is extracted from the concatenation cost database 310 and assigned to the acoustic unit sequential pair.

In contrast, in step 608, because the concatenation cost 430 for the immediate sequential pair is absent from the concatenation cost database 310, a large default concatenation cost is assigned to the acoustic unit sequential pair. The large default cost should be sufficient to eliminate the join under any reasonable circumstances (such as reasonable pruning), but not so large as to totally preclude the sequence of acoustic units entirely. It can be possible that situations will arise in which the Viterbi search must consider only two sets of acoustic unit sequences for which there are no cached concatenation costs. Unit selection must continue based on the default concatenation costs and must select one of the sequences. The fact that all the concatenation costs are the same is mitigated by the target costs, which do still vary and provide a means to distinguish better candidates from worse.

Alternatively to the default assignment of step 608, the actual concatenation cost can be computed. However, an absence from the concatenation cost database 310 indicates that the transition is unlikely to be chosen.

Figure 7:
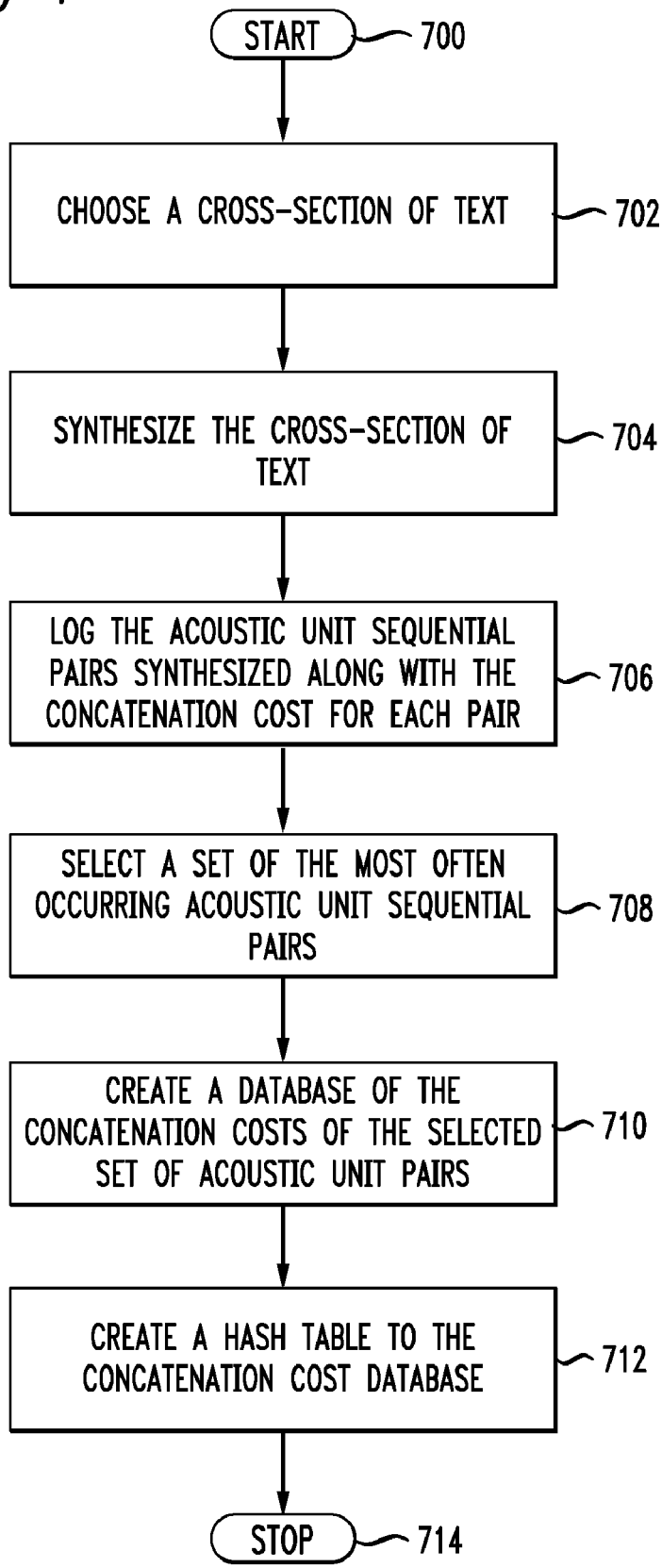
FIG. 7 is a flowchart outlining an exemplary operation of the text-to-speech synthesizer for determining the concatenation cost for an acoustic sequential pair.

FIG. 7 shows an exemplary method to form an efficient concatenation cost database 310. The operation starts with step 700 and proceeds to step 702, where a large cross-section of text is selected. The selected text can be any body of text; however, as a body of text increases in size and the selected text increasingly represents current spoken language, the concatenation cost database 310 can become more practical and efficient. The concatenation cost database 310 of the exemplary embodiment can be formed, for example, by using a training set of ten thousand (10,000) synthesized Associated Press (AP) newswire stories.

In step 704, the selected text is synthesized using a speech synthesizer. Next, in step 706, the occurrence of each acoustic unit 432 synthesized in step 704 is logged along with the concatenation costs 430 for each acoustic unit sequential pair. In the exemplary embodiment, the AP newswire stories selected produced approximately two hundred and fifty thousand (250,000) sentences containing forty-eight (48) million half-phones and logged a total of fifty (50) million non-unique acoustic unit sequential pairs representing a mere 1.2 million unique acoustic unit sequential pairs.

In step 708, a set of acoustic unit sequential pairs and their associated concatenation costs 430 are selected. The set chosen can incorporate every unique acoustic sequential pair observed or any subset thereof without deviating from the spirit and scope of the present invention.

Alternatively, the acoustic unit sequential pairs and their associated concatenation costs 430 can be formed by any selection method, such as selecting only acoustic unit sequential pairs that are relatively inexpensive to concatenate, or join. Any selection method based on empirical or theoretical advantage can be used without deviating from the spirit and scope of the present invention.

In the exemplary embodiment, subsequent tests using a separate set of eight thousand (8000) AP sentences produced 1.5 million non-unique acoustic unit sequential pairs, 99% of which were present in the training set. The tests and subsequent results are more fully described in Beutnagel, Mohri, and Riley, "Rapid Unit Selection from a large Speech Corpus for Concatenative Speech Synthesis," *Proc. European Conference on Speech, Communication and Technology* (*Eurospeech*), Budapest, Hungary (September 1999) incorporated herein by reference. Experiments show that by caching 0.7% of the possible joins, 99% of join cost are covered with a default concatenation cost being otherwise substituted.

In step 710, a concatenation cost database 310 is created to incorporate the concatenation costs 430 selected in step 708. In the exemplary embodiment, based on the above statistics, a concatenation cost database 310 can be constructed to incorporate concatenation costs 430 for about 1.2 million acoustic unit sequential pairs.

Next, in step 712, a hash table 308 is created for quick referencing of the concatenation cost database 310 and the process ends with step 714. A hash table 308 provides a more compact representation given that the values used are very sparse compared to the total search space. In the present example, the hash function maps two unit numbers to a hash table 308 entry containing the concatenation costs plus some additional information to provide quick look-up.

To further improve performance and avoid the overhead associated with the general hashing routines, the present example implements a perfect hashing scheme such that membership queries can be performed in constant time. The perfect hashing technique of the exemplary embodiment is presented in detail below and is a refinement and extension of the technique presented by Robert Endre Tarjan and Andrew Chi-Chih Yao, "Storing a Sparse Table", *Communications of the ACM*, vol. 22:11, pp. 606-11, 1979, incorporated herein by reference. However, any technique to access membership to the concatenation cost database 310, including non-perfect hashing systems, indices, tables, or any other means now known or later developed can be used without deviating from the spirit and scope of the invention.

The above-detailed invention produces a very natural and intelligible synthesized speech by providing a large database of acoustical units while drastically reducing the computer overhead needed to produce the speech.

It is important to note that the invention can also operate on systems that do not necessarily derive their information from text. For example, the invention can derive original speech from a computer designed to respond to voice commands.

The invention can also be used in a digital recorder that records a speaker's voice, stores the speaker's voice, then later reconstructs the previously recorded speech using the acoustic unit selection system 208 and speech synthesis back-end 210.

Another use of the invention can be to transmit a speaker's voice to another point wherein a stream of speech can be converted to some intermediate form, transmitted to a second point, then reconstructed using the acoustic unit selection system 208 and speech synthesis back-end 210.

Another embodiment of the invention can be a voice disguising method and apparatus. Here, the acoustic unit selection technique uses an acoustic unit database 306 derived from an arbitrary person or target speaker. A speaker providing the original speech, or originating speaker, can provide a stream of speech to the apparatus wherein the apparatus can reconstruct the speech stream in the sampled voice of the target speaker. The transformed speech can contain all or most of the subtleties, nuances, and inflections of the originating speaker, yet take on the spectral qualities of the target speaker.

Yet another example of an embodiment of the invention would be to produce synthetic speech representing non-speaking objects, animals or cartoon characters with reduced reliance on signal processing. Here the acoustic unit database 306 would comprise elements or sound samples derived from target speakers such as birds, animals or cartoon characters. A stream of speech entered into an acoustic unit selection system 208 with such an acoustic unit database 306 can produce synthetic speech with the spectral qualities of the target speaker, yet can maintain subtleties, nuisances, and inflections of an originating speaker.

Figure 6:
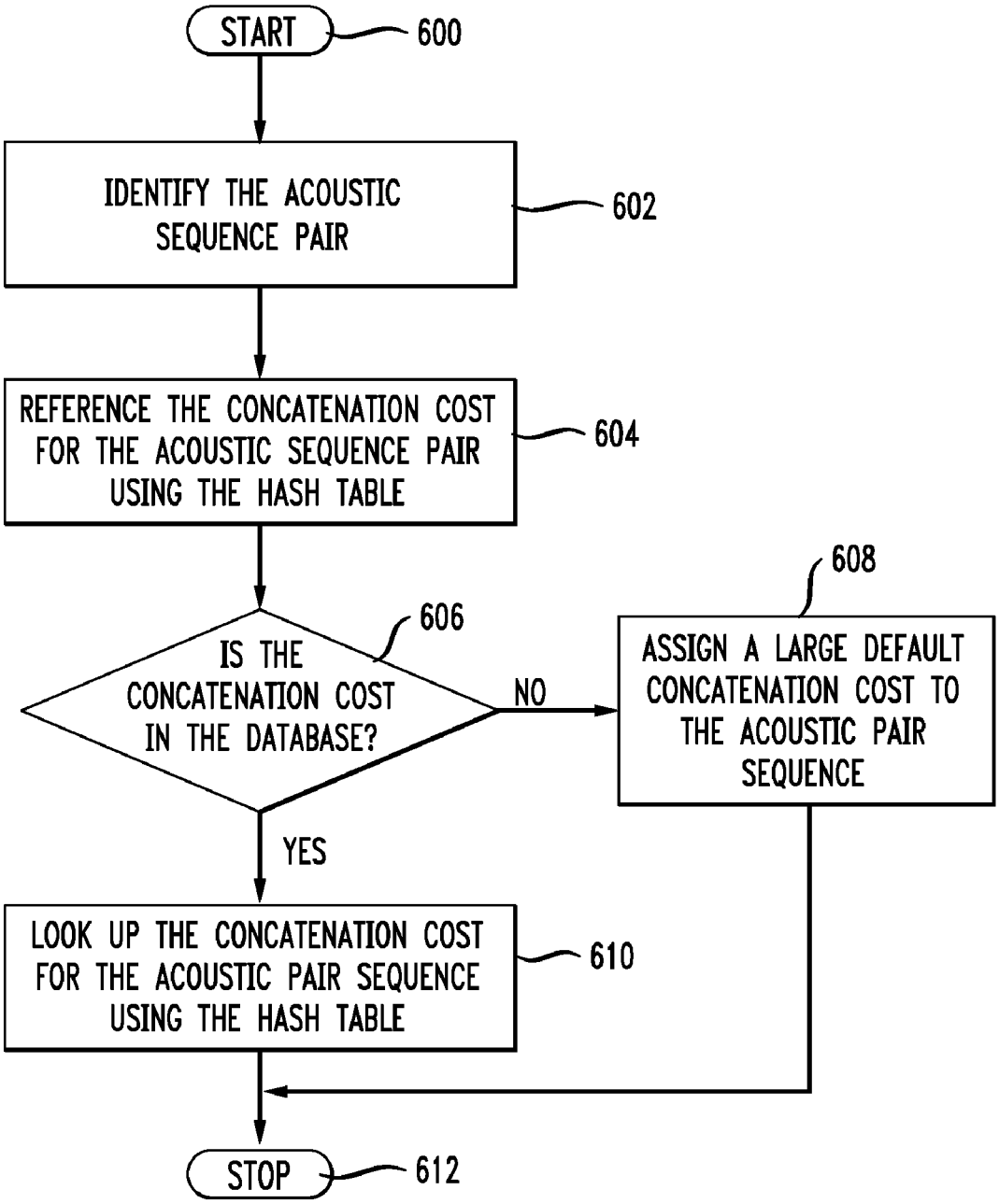
FIG. 6 is a flowchart outlining an exemplary operation of the text-to-speech synthesizer for forming a concatenation cost database.

As shown in FIGS. 2 and 3, the method of this invention is preferably implemented on a programmed processor. However, the text-to-speech synthesizer 104 and the acoustic unit selection device 208 can also be implemented on a general purpose or a special purpose computer, a programmed microprocessor or micro-controller andperipheral integrated circuit elements, an Application Specific Integrated Circuit (ASIC), or other integrated circuit, a hardware electronic or logic circuit such as a discrete element circuit, a programmable logic device such as a PLD, PLA, FPGA, or PAL, or the like. In general, any device on which exists a finite state machine capable of implementing the apparatus shown in FIGS. 2-3 or the flowcharts shown in FIGS. 5-6 can be used to implement the text-to-speech synthesizer 104 functions of this invention.

The exemplary technique for forming the hash table described above is a refinement and extension of the hashing technique presented by Tarjan and Yao. It consists of compacting a matrix-representation of an automaton with state set Q and transition set E by taking advantages of its sparseness, while using a threshold θ to accelerate the construction of the table.

The technique constructs a compact one-dimensional array "C" with two fields: "label" and "next." Assume that the current position in the array is "k", and that an input label "l" is read. Then that label is accepted by the automaton if label [C[k+l]]=1 and, in that case, the current position in the array becomes next[C[k+l]].

These are exactly the operations needed for each table look-up. Thus, the technique is also nearly optimal because of the very small number of elementary operations it requires. In the exemplary embodiment, only three additions and one equality test are needed for each look-up.

The pseudo-code of the technique is given below. For each state q∈Q, E[q] represents the set of outgoing transitions of "Q." For each transition e∈E, i[e] denotes the input label of that transmission, n[e] its destination state.

The technique maintains a Boolean array "empty", such that empty[e]=FALSE when position "k" of array "C" is non-empty. Lines 1-3 initialize array "C" by setting all labels to UNDEFINED, and initialize array "empty" to TRUE for all indices.

The loop of lines 5-21 is executed |Q| times. Each iteration of the loop determines the position pos[q] of the state "q" (or the row of index "q") in the array "C" and inserts the transitions leaving "q" at the appropriate positions. The original position to the row is 0 (line 6). The position is then shifted until it does not coincide with that of a row considered in previous iterations (lines 7-13).

Lines 14-17 check if there exists an overlap with the row previously considered. If there is an overlap, the position of the row is shifted by one and the steps of lines 5-12 are repeated until a suitable position is found for the row of index "q." That position is marked as non-empty using array "empty", and as final when "q" is a final state. Non-empty elements of the row (transitions leaving q) are then inserted in the array "C" (lines 16-18). Array "pos" is used to determine the position of each state in the array "C", and thus the corresponding transitions.

Compact TABLE (Q, F, θ, step)

```
1   for k ← 1 to length[C]
2       do label [C[k]] ← UNDEFINED
3           empty [k] ← TRUE
4   wait ←m ← 0
5   for each q ∈ Q order
6       do pos[q] ← m
7           while empty[pos[q]] = FALSE
8               do wait ←wait +1
9                   if (wait > θ)
10                      then wait ← 0
11                          m ← pos[q]
12                          pos[q] ← pos[q] + step
13                      else pos[q] ← pos[q] +1
14          for each e ∈ E[q]
15              do if label[C[pos[q] + i [e]]] ≠ UNDEFINED
16                  then pos[q] ←pos[q]+1
17                      goto line 7
18          empty[pos[q]] ← FALSE
19          for each e ∈ E[q]
20              do label[C[pos[q] + i [e]]] ← i[e]
21                  next [C[pos[q] + i[e]]] ← n[e]
22  for k ←1 to length[C]
23      do if label[C[k]] ≠ UNDEFINED
24          then next[C[k]] ←pos[next[C[k]]]
```

A variable "wait" keeps track of the number of unsuccessful attempts when trying to find an empty slot for a state (line 8). When that number goes beyond a predefined waiting threshold θ (line 9), "step" calls are skipped to accelerate the technique (line 12), and the present position is stored in variable "m" (line 11). The next search for a suitable position will start at "m" (line 6), thereby saving the time needed to test the first cells of array "C", which quickly becomes very dense.

Array "pos" gives the position of each state in the table "C". That information can be encoded in the array "C" if attribute "next" is modified to give the position of the next state pos[q] in the array "C" instead of its number "q". This modification is done at lines 22-24.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. Accordingly, there are changes that can be made without departing from the spirit and scope of the invention.

What is claimed is:

1. A method comprising:

determining, via a processor, whether an acoustic unit sequential pair to be used for synthesizing speech has a concatenation cost in a concatenation cost database;

if the concatenation cost database does not contain the concatenation cost for the acoustic unit sequential pair, then assigning a default value as the concatenation cost; and updating the concatenation cost database by synthesizing a body of speech and identifying acoustic unit sequential pairs generated in the body of speech and respective concatenation costs.

2. The method of claim 1, further comprising synthesizing the speech using the default value as assigned for the acoustic unit sequential pair.

3. The method of claim 1, wherein the concatenation cost database contains a portion of all possible concatenation costs.

4. The method of claim 1, wherein the concatenation cost database is derived using statistical techniques which predict which acoustic unit sequential pairs are most likely to occur in common speech.

5. The method of claim 1, wherein the concatenation cost comprises a weighted sum of subcosts across phones.

6. The method of claim 1, wherein the concatenation cost provides an estimate of an acoustic mismatch between units in the acoustic unit sequential pair.

7. A system comprising:

a processor;

a first module configured to control the processor to determine whether an acoustic sequential pair to be used for synthesizing speech has a concatenation cost and a concatenation database;

a second module configured to control the processor, if the concatenation cost database does not contain the concatenation cost for the acoustic unit sequential pair, to assign a default value as the concatenation cost; and a third module configured to control the processor to update the concatenation cost database by synthesizing a body of speech and identifying acoustic unit sequential pairs generated in the body of speech and respective concatenation costs.

8. The system of claim 7, further comprising a third module configured to control the processor to synthesize the speech using the default value as assigned for the acoustic unit sequential pair.

9. The system of claim 7, wherein the concatenation cost database contains a portion of all possible concatenation costs.

10. The system of claim 7, wherein the concatenation cost database is derived using statistical techniques which predict which acoustic unit sequential pairs are most likely to occur in common speech.

11. The system of claim 7, wherein the concatenation cost comprises a weighted sum of subcosts across phones.

12. The system of claim 7, wherein the concatenation cost provides an estimate of an acoustic mismatch between units in the acoustic unit sequential pair.

13. A method comprising:

determining, via a processor, whether an acoustic unit sequential pair to be used for synthesizing speech has a concatenation cost and a concatenation cost database;

if the concatenation cost database does not contain the concatenation cost for the acoustic unit sequential pair, then deriving an actual concatenation cost for the acoustic unit sequential pair; and updating the concatenation cost database by synthesizing a body of speech and identifying acoustic unit sequential pairs generated in the body of speech and respective concatenation costs.

14. The method of claim 13, further comprising synthesizing the speech using the actual concatenation cost for the acoustic unit sequential pair.

15. The method of claim 13, wherein the concatenation cost database contains a portion of all possible concatenation costs.

16. The method of claim 13, wherein the concatenation cost database is derived using statistical techniques which predict which acoustic unit sequential pairs are most likely to occur in common speech.

17. The method of claim 13, wherein the concatenation cost provides an estimate of an acoustic mismatch between units in the acoustic unit sequential pair.

* * * * *